US008315880B2

(12) United States Patent
Kovesi et al.

(10) Patent No.: US 8,315,880 B2
(45) Date of Patent: Nov. 20, 2012

(54) METHOD FOR BINARY CODING OF QUANTIZATION INDICES OF A SIGNAL ENVELOPE, METHOD FOR DECODING A SIGNAL ENVELOPE AND CORRESPONDING CODING AND DECODING MODULES

(75) Inventors: Balazs Kovesi, Lannion (FR); Stéphane Ragot, Lannion (FR)

(73) Assignee: France Telecom, Paris (FR)

( * ) Notice: Subject to any disclaimer, the term of this patent is extended or adjusted under 35 U.S.C. 154(b) by 1093 days.

(21) Appl. No.: 12/280,644

(22) PCT Filed: Feb. 13, 2007

(86) PCT No.: PCT/FR2007/050781

§ 371 (c)(1),
(2), (4) Date: Aug. 25, 2008

(87) PCT Pub. No.: WO2007/096551

PCT Pub. Date: Aug. 30, 2007

(65) Prior Publication Data

US 2009/0030678 A1 Jan. 29, 2009

(30) Foreign Application Priority Data

Feb. 24, 2006 (FR) ..... 06 50638

(51) Int. Cl.
*G10L 19/00* (2006.01)

(52) U.S. Cl. ..... 704/500; 704/229; 704/230; 704/503

(58) Field of Classification Search ..... 704/500–504
See application file for complete search history.

(56) References Cited

U.S. PATENT DOCUMENTS

| | | | | |
|---|---|---|---|---|
| 4,815,068 | A * | 3/1989 | Dolby et al. | 369/88 |
| 5,115,469 | A * | 5/1992 | Taniguchi et al. | 704/228 |
| 6,484,142 | B1 * | 11/2002 | Miyasaka et al. | 704/500 |
| 6,625,226 | B1 * | 9/2003 | Gersho et al. | 375/285 |
| 6,845,360 | B2 * | 1/2005 | Jensen et al. | 704/500 |
| 6,940,900 | B2 * | 9/2005 | Takamizawa | 375/240 |
| 7,260,540 | B2 * | 8/2007 | Miyasaka et al. | 704/500 |
| 7,788,090 | B2 * | 8/2010 | Van De Par et al. | 704/200.1 |
| 2003/0083886 | A1 * | 5/2003 | Den Brinker et al. | 704/500 |
| 2004/0015766 | A1 | 1/2004 | Toyama et al. | |
| 2004/0202375 | A1 * | 10/2004 | Kalevo | 382/239 |
| 2005/0256701 | A1 * | 11/2005 | Makinen | 704/223 |
| 2005/0261900 | A1 * | 11/2005 | Ojala et al. | 704/223 |
| 2006/0069550 | A1 * | 3/2006 | Todd et al. | 704/212 |

FOREIGN PATENT DOCUMENTS

| | | |
|---|---|---|
| EP | 0 361 384 | 4/1990 |
| EP | 1 345 331 | 9/2003 |
| WO | WO 98/15945 | 4/1998 |

* cited by examiner

*Primary Examiner* — Jialong He
(74) *Attorney, Agent, or Firm* — Cozen O'Connor

(57) ABSTRACT

A module (402) for binary coding of a signal envelope, comprising coding module (502) for coding a variable length first mode. The coding module for coding the first mode incorporates an envelope saturation detector and said coding module (402) further includes a second coding module (503) for coding a second mode in parallel with the coding module (502) for coding the first mode and a mode selector (504) adapted to select one of the two coding modes as a function of a code length criterion and of the result from the envelope saturation detector.

16 Claims, 11 Drawing Sheets

| Sub-band | 0 | 1 | 2 | 3 | 4 | 5 | 6 | 7 | 8 | 9 | 10 | 11 | 12 | 13 |
|---|---|---|---|---|---|---|---|---|---|---|---|---|---|---|
| Min (bits) | 5 | 3 | 3 | 3 | 3 | 3 | 3 | 2 | 2 | 3 | 3 | 2 | 2 | 2 |
| Max (bits) | 5 | 12 | 16 | 14 | 13 | 14 | 14 | 16 | 15 | 13 | 14 | 14 | 16 | 14 |

FIG. 3 (prior art)

(a) Table *tabis* defining division of MDCT spectrum into K=18 sub-bands

| *j* | 0 | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|---|
| *tabis(j)* | 0 | 16 | 32 | 48 | 64 | 80 | 96 | 112 | 128 | 144 | 160 | 176 | 192 | 208 | 224 | 240 | 256 | 272 | 280 |

(b) Table nb_coeff defining size of K=18 sub-bands

| *j* | 0 | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|---|
| *nb_coeff(j)* | 16 | 16 | 16 | 16 | 16 | 16 | 16 | 16 | 16 | 16 | 16 | 16 | 16 | 16 | 16 | 16 | 16 | 8 |

FIG. 7

| Value of *diff_index*(j) | Huffman code word | Code word length (bits) |
|---|---|---|
| -12 | 0x0006 | 11 |
| -11 | 0x0007 | 11 |
| -10 | 0x0012 | 11 |
| -9 | 0x0008 | 10 |
| -8 | 0x0005 | 9 |
| -7 | 0x0003 | 8 |
| -6 | 0x0003 | 7 |
| -5 | 0x0002 | 6 |
| -4 | 0x0002 | 5 |
| -3 | 0x000c | 4 |
| -2 | 0x0001 | 3 |
| -1 | 0x0001 | 2 |
| 0 | 0x0002 | 2 |
| 1 | 0x0007 | 3 |
| 2 | 0x000d | 4 |
| 3 | 0x0003 | 5 |
| 4 | 0x0003 | 6 |
| 5 | 0x0002 | 7 |
| 6 | 0x0001 | 8 |
| 7 | 000000 | 9 |
| 8 | 0x0002 | 10 |
| 9 | 0x0027 | 12 |
| 10 | 0x004c | 13 |
| 11 | 0x009b | 14 |
| 12 | 0x009a | 14 |

FIG. 8

METHOD FOR BINARY CODING OF QUANTIZATION INDICES OF A SIGNAL ENVELOPE, METHOD FOR DECODING A SIGNAL ENVELOPE AND CORRESPONDING CODING AND DECODING MODULES

RELATED APPLICATIONS

This is a U.S. national stage under 35 USC 371 of application No. PCT/FR2007/050781, filed on Feb. 13, 2007.

This application claims the priority of French patent application no. 06/50638 filed Feb. 24, 2006, the content of which is hereby incorporated by reference.

FIELD OF THE INVENTION

The invention relates to a method of binary coding quantization indices defining a signal envelope. It also relates to a binary coding module for implementing the method. It further relates to a method and a module for decoding an envelope coded by the binary coding method and the binary coding module of the invention.

The invention finds a particularly advantageous application to transmitting and staring digital signals, such as audio-frequency speech, music, etc. signals. The coding method and the coding module of the invention are more specifically adapted to transform coding of audio-frequency signals.

BACKGROUND OF THE INVENTION

There are various techniques for digitizing and compressing audio-frequency speech, music, etc. signals. The methods most widely used are:

"waveform coding" methods such as PCM and ADPCM coding;

"parametric analysis-synthesis coding" methods, such as code excited linear prediction (CELP) coding;

"sub-band or transform perceptual coding" methods.

These classic techniques for coding audio-frequency signals are described in W. B. Kleijn and K. K. Paliwal, Editors, "Speech Coding and Synthesis", Elsevier, 1995.

As indicated above, the invention is essentially concerned with transform coding techniques.

ITU-T Recommendation G.722.1, "Coding at 24 kbit/s and 32 kbit/s for hands-free operation in systems with low frame loss", September 1999, describes a transform coder for compressing speech or music audio signals in a pass-band from 50 hertz 'Hz) to 7000 Hz, referred to as the wide band, at a sampling frequency of 16 kilohertz (kHz) and at a bit rate of 24 kilobits per second (kbit/s) or 32 kbit/s. FIG. 1 shows the associated coding scheme, as set out in the aforementioned Recommendation.

As this figure shows, the G.722.1 coder is based on the modulated lapped transform (MLT) The frame length is 20 milliseconds (ms) and the frame contains N=320 samples.

The MLT transform, modulated transform with Malvar overlap, is a variant of the MDCT (modified discrete cosine transform).

FIG. 2 shows in outline the principle of MDCT.

The MDCT transform X(m) of a signal x(n) of length L=2N comprising samples of the current frame and the future frame is defined as follows, where m=0, . . . , N−1:

$$X(m) = \sum_{n=0}^{L-1} \frac{\sqrt{2}}{N} \sin\left(\frac{\pi}{L}(n+0.5)\right)\cos\left(\frac{\pi}{N}(n+N/2+0.5)(m+0.5)\right)x(n)$$

In the above formula, the sine term corresponds to the windowing shown in FIG. 2. The calculation of X(m) therefore corresponds to the projection of x(n) onto a local cosine base with sinusoidal windowing. Fast MDCT calculation algorithms exist (see for example the paper by P. Duhamel, Y. Mahieux, J. P. Petit, "A fast algorithm for the implementation of filter banks based on time domain aliasing cancellation", ICASSP, vol. 3, pp. 2209-2212, 1991).

To calculate the spectral envelope of the transform, the values X(0), . . . , X(N−1) derived by MDCT are grouped into 16 sub-bands of 20 coefficients. Only the first 14 sub-bands (14×20=280 coefficients) are quantized and coded, corresponding to the frequency band 0-7000 Hz, the 7000-8000 band (40 coefficients) being ignored.

The value of the spectral envelope for the $j^{th}$ sub-band is defined in the logarithmic domain as follows, where j=0, . . . , 13, the term E serving to avoid $\log_2(0)$:

$$\text{log_rms}(j) = \frac{1}{2}\log_2\left(\sqrt{\frac{1}{20}\sum_{n=0}^{19} X^2(20j+n)} + \varepsilon\right)$$

This envelope therefore corresponds to the root mean square value per sub-band.

The spectral envelope is then quantized in the following manner:

The set of values $$\text{log_}rms=\{log_rms(0)\text{log_}rms(1) \ldots \text{log_}rms(13)\}$$

is first rounded to:

$$rms_\text{index}=\{rms_\text{index}(0)rms_\text{index}(1) \ldots rms_\text{index}(13)\}$$

where the indices rms_index(j) are rounded to the integer closest to log_rms(j)×0.5 for j=0, . . . , 13.

The quantization step is therefore $20\times\log_{10}(2^{0.5})=3.0103 \ldots$ dB. The values obtained are bounded:

$$3 \leqq rms_\text{index}(0) \leqq 33 \text{(dynamic range } 31\times3.01=93.31 \text{ dB) for j=0; and}$$

$$-6 \leqq rms_\text{index}(j) \leqq 33 \text{(dynamic range } 40\times3.01=120.4 \text{ dB) for j=1, . . . , 13.}$$

The rms_index values for the last 13 bands are then transformed into differential indices by calculating the difference between the rms values of the spectral envelope of one sub-band and the preceding sub-band:

$$diff_rms_\text{index}(j)=rms_\text{index}(j)-rms_\text{index}(j-1) \text{ for j=1, . . . , 13}$$

These differential indices are also bounded:

$$-12. \leqq diff_rms_\text{index}(j) \leqq 11; \text{ for j=1, . . . , 13}$$

Below the expression "range of quantization indices" refers to the range of indices that can be represented by binary coding. In the G.722.1 coder, the range of differential indices is limited to the range [−11, 12]. Thus the range of the G.722.1 coder is said to be "sufficient" for coding the differences between rms_index(j) and rms_index(j−1) if $$-12 \leqq rms_\text{index}(j)-rms_\text{index}(j-1) \leqq 11$$

Otherwise, the range of the G.722.1 coder is said to be "insufficient". Thus spectral envelope coding reaches saturation as soon as the rms difference between two sub-bands exceeds 12×3.01=36.12 decibels (dB).

The quantization index rms_index(0) is transmitted in the G.722.1 coder on 5 bits. The differential quantizing indices diff_rms_index(j) (j=1, . . . , 13) are coded by Huffman coding, each variable having its own Huffman table. This coding is therefore entropic coding of variable length, the principle of which is to assign a code that is short in terms of bits to the most probable differential index values, the least probable differential quantization index values having a longer code. This type of coding is very efficient in terms of mean bit rate, bearing in mind that the total number of bits used to code the spectral envelope in G.722.1 is around 50 bits on average. However, as becomes clear below, the worst case scenario is out of control.

The FIG. 3 table gives for each sub-band the length of the shortest code (Min), and thus that of the most probable value (best case), and that of the longest code (Max), and thus that of the least probable value (worst case). Note that in this table the first sub-band (j=0) has a fixed length of 5 bits, in contrast to the subsequent sub-bands.

With these code length values, it is seen that in the best case encoding the spectral envelope requires 39 bits (1.95 kbit/s) and that the theoretical worst case is 190 bits (9.5 kbit/s).

In the G.722.1 coder, the bits remaining after coding the quantization indices of the spectral envelope are then distributed to code the MDCT coefficients normalized by the quantized envelope. Assignment of bits in the sub-bands is effected by a categorization process that is not related to the present invention and is not described in detail here. The remainder of the G.722.1 process is not described in detail for the same reason.

Coding the MDCT spectral envelope in the G.722.1 coder has a number of drawbacks.

As indicated above, variable length coding can lead to using a very large number of bits for coding the spectral envelope in the worst case. Also, it is also pointed out above that the risk of saturation for some signals of high spectral disparity, for example isolated sinusoids, differential coding does not work because the range ±36.12 dB cannot represent all of the dynamic range of the differences between the rms values.

SUMMARY OF THE INVENTION

One object of the present invention is to provide a method of binary coding quantization indices defining a signal envelope that includes a variable length coding step and would minimize the coding length to a limited number of bits, even in the worst case.

Moreover, another problem to be solved by the invention concerns managing the risk of saturation for signals having high rms value, such as sinusoids.

These and other objects are attained in accordance with one aspect of the present invention directed to a method of binary coding quantization indices defining a signal envelope, comprising a variable length first coding mode, wherein the first coding mode incorporates envelope saturation detection and said method also includes a second coding mode, executed in parallel with the first coding mode and selection of one of the two coding modes as a function of a code length criterion and the result of detecting envelope saturation in the first coding mode.

Such a method is based on the concurrence of two coding modes, one or each of which is of variable length, so as to be able to choose the mode yielding the lower number of coding bits, in particular in the worst case, i.e. for the least probable rms values.

Moreover, if one of the coding modes leads to saturation of the rms value of a sub-band, the other mode is "forced" and assumes priority, even if it leads to a greater coding length.

In a preferred implementation, the second coding mode is selected if one or more of the following conditions is satisfied:

- the code length of the second coding mode is shorter than the code length of the first coding mode;
- detection of envelope saturation of the first coding mode indicates saturation.

Another aspect of the present invention is directed to a module for binary coding of a signal envelope, comprising a module for coding a variable length first mode, noteworthy in that said coding module of a first mode incorporates an envelope saturation detector and said coding module also includes a second module for coding a second mode, in parallel with the module for coding the first mode, and a mode selector for retaining one of the two coding modes as a function of a code length criterion and the result from the envelope saturation detector.

In addition to selecting the most appropriate code, the mode selector is able to generate a retained coding mode indicator in order to indicate to the downstream decoder, which decoding mode it must apply.

Another aspect of the invention is directed to a method of decoding a signal envelope, said envelope being coded by the binary coding method of the invention, noteworthy in that said decoding method includes a step of detecting said selected coding mode indicator and a decoding step in accordance with the selected coding mode.

Another aspect of the invention is directed to a module for decoding a signal envelope, said envelope being coded by the binary coding module of the invention, said decoding module comprising a decoding module for decoding a variable length first mode, noteworthy in that said decoding module also includes a second decoding module for decoding a second mode in parallel with said decoding module for decoding the variable length first mode and a mode detector adapted to detect said coding mode indicator and to activate the decoding module corresponding to the detected indicator.

Another aspect of the invention is directed to a program comprising instructions stored on a computer-readable medium for executing the steps of the method of the invention.

BRIEF DESCRIPTION OF THE DRAWINGS

FIG. 3 is a table of the minimum length (Min) and the maximum length (Max) in bits of the codes in each sub-band in Huffman coding for the FIG. 1 coder;

FIG. 7 contains a table (a) defining the division of the MDCT spectrum into 18 sub-bands and a table (b) giving the size of the sub-bands;

FIG. 8 is a table of an example of Huffman codes for representing the differential indices;

DETAILED DESCRIPTION OF THE DRAWINGS

The invention is described in the context of a particular type of hierarchical audio coder operating at 8 kbit/s to 32 kbit/s. However, it must be clearly understood that the methods and modules according to the invention for binary coding and decoding of spectral envelopes are not limited to this type of coder and can be applied to any form of spectral envelope binary coding defining the energy in sub-bands of a signal.

Figure 4:
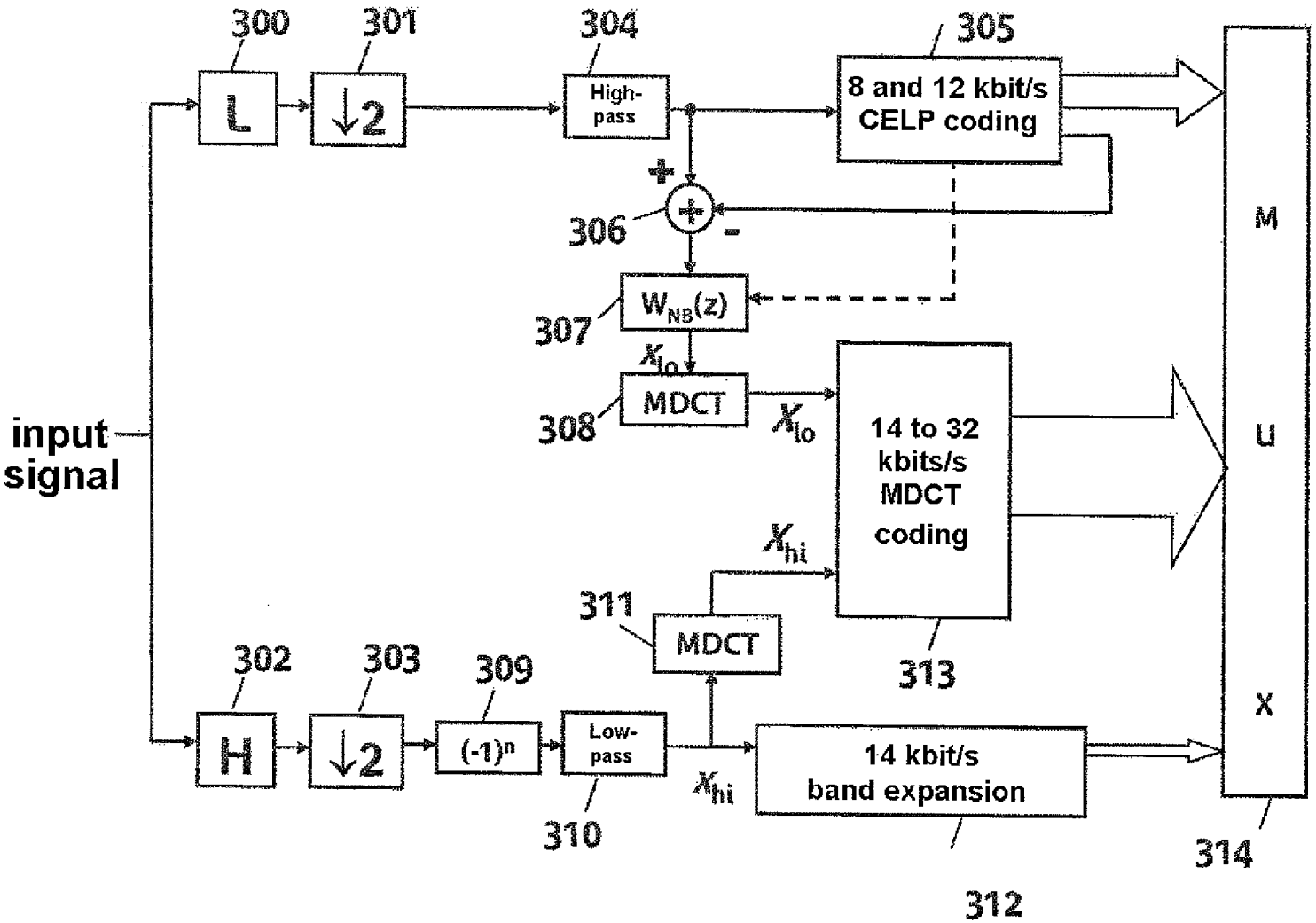
FIG. 4 is a diagram of a hierarchical audio coder including an MDCT coder provided in an embodiment of the invention.

As shown in FIG. 4, the input signal of the wide-band hierarchical coder sampled at 16 kHz is first divided into two sub-bands by a quadrature mirror filter (QMF). The low band, from 0 to 4000 Hz, is obtained by low-pass filtering 300 and decimation 301 and the high band, from 4000 to 8000 Hz, by high-pass filtering 302 and decimation 303. In a preferred embodiment, the filter 300 and the filter 302 are of length 64 and are as described in the paper by J. Johnston, "A filter family designed for use in quadrature mirror filter banks", ICASSP, vol. 5, pp. 291-294, 1980.

The low band is pre-processed by a high-pass filter 304 eliminating components below 50 Hz before CELP coding 305 in the narrow band (50 Hz to 4000 Hz). The high-pass filtering takes account of the fact that the wide band is defined as the 50 Hz to 7000 Hz band. In the embodiment described, the form of narrow band CELP coding 305 used corresponds to cascade CELP coding comprising as a first stage modified G.729 coding (ITU-T G.729 Recommendation, "Coding of Speech at 8 kbit/s using Conjugate Structure Algebraic Code Excited Linear Prediction (CS-ACELP)", March 1996) with no pre-processing filter, and as a second stage a additional fixed dictionary. The CELP coding error signal is calculated by the subtractor 306 and then weighted perceptually by a $W_{NB}(z)$ filter 307 to obtain the signal $x_{lo}$. That signal is analyzed by a modified discrete cosine transform (MDCT) 308 to obtain the discrete transformed spectrum $X_{lo}$.

Aliasing in the high band is first cancelled 309 to compensate aliasing caused by the H QMF filter 302, after which the high band is pre-processed by a low-pass filter 310 eliminating components in the range 7000 Hz to 8000 Hz in the original signal. The resulting signal $X_{hi}$ is subjected to an MDCT transform 311 to obtain the discrete transformed spectrum $X_{hi}$. Band expansion 31 is effected on the basis of $x_{hi}$ and $X_{hi}$.

Figure 1:
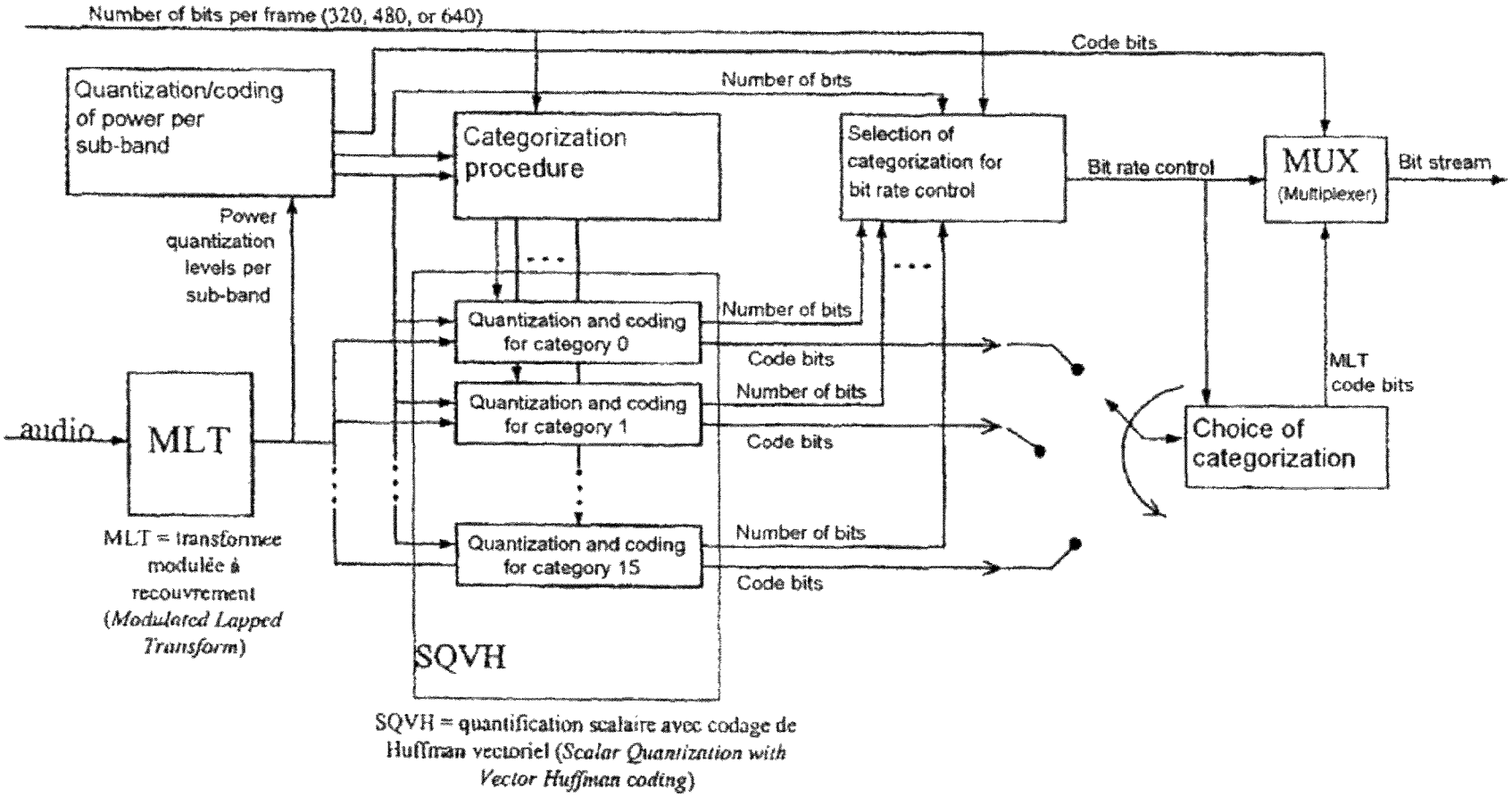
FIG. 1. (prior art)
FIG. 1 is a diagram of a coder conforming to the G.722.1 Recommendation.
Figure 2:
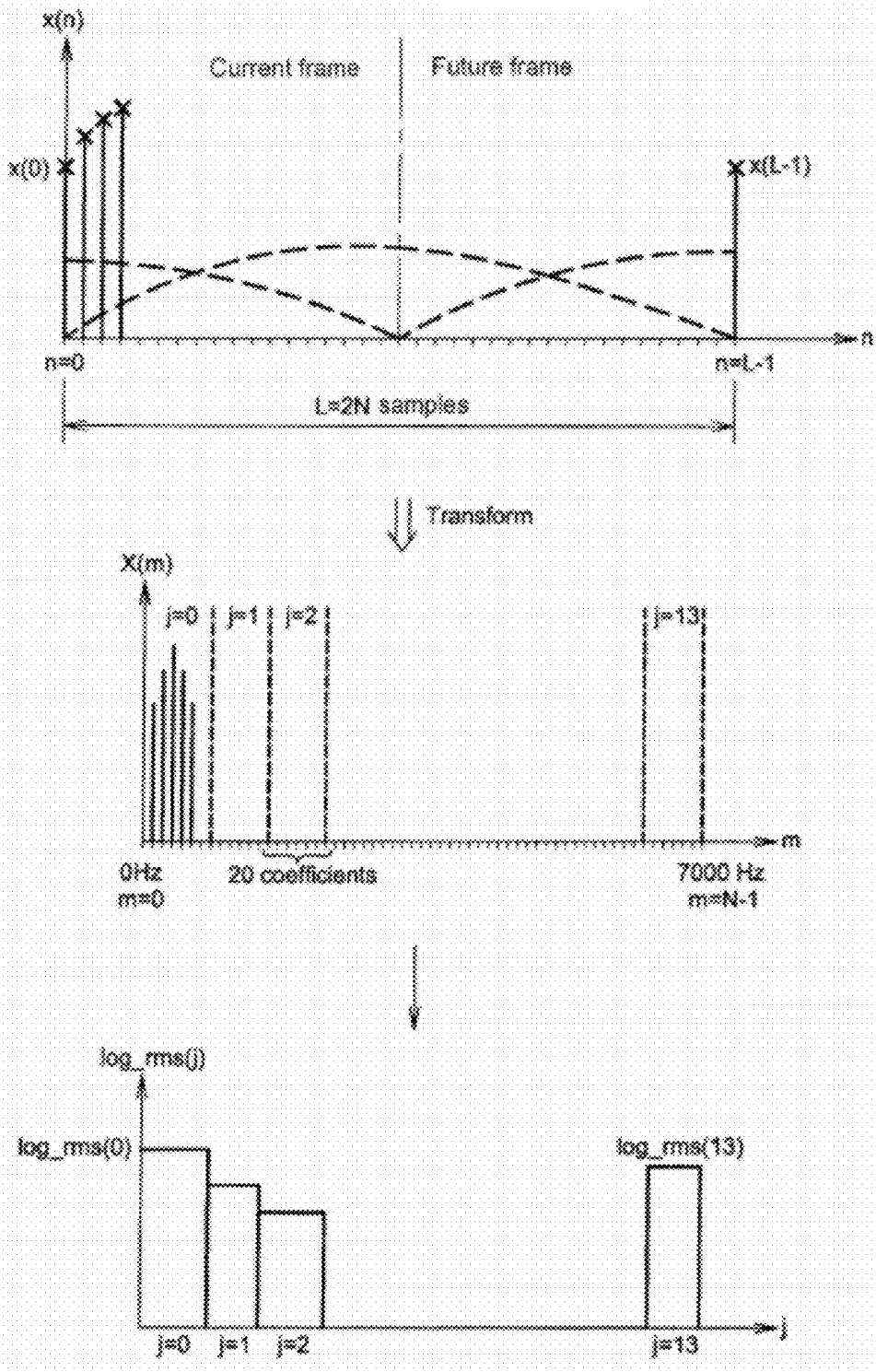
Fig. 2 (prior art)
FIG. 2 is a diagram representing an MDCT type transform.

As explained already with reference to FIG. 2, the signals $x_{lo}$, and $x_{hi}$ are divided into frames of N samples, and an MDCT transform of length L=2N analyses current and future frames. In a preferred embodiment, $x_{lo}$, and $x_{hi}$ are narrow-band signals sampled at 8 kHz, and N=160 (20 ms). The MDCT transforms $X_{lo}$ and $X_{hi}$ therefore include N=160 coefficients and each coefficient then represents a frequency band of 4000/160=25 Hz. In a preferred embodiment, the MDCT transform is implemented by the algorithm described by P. Duhamel, Y. Mahieux, J. P. Petit, "A fast algorithm for the implementation of filter banks based on 'time domain aliasing cancellation'", ICASSP, vol. 3, pp. 2209-2212, 1991.

The low-band and high-band MDCT spectra $X_{lo}$ and $X_{hi}$ are coded in the transform coding module 313. The invention relates more specifically to this coder.

The bit streams generated by the coding modules 305, 312 and 313 are multiplexed and structured into a hierarchical bit stream in the multiplexer 314. Coding is effected by 20 ms blocks of samples (frames), i.e. blocks of 320 samples. The coding bit rate is 8 kbit/s, 12 kbit/s, 14 kbit/s to 32 kbit/s in 2 kbit/s steps.

Figure 5:
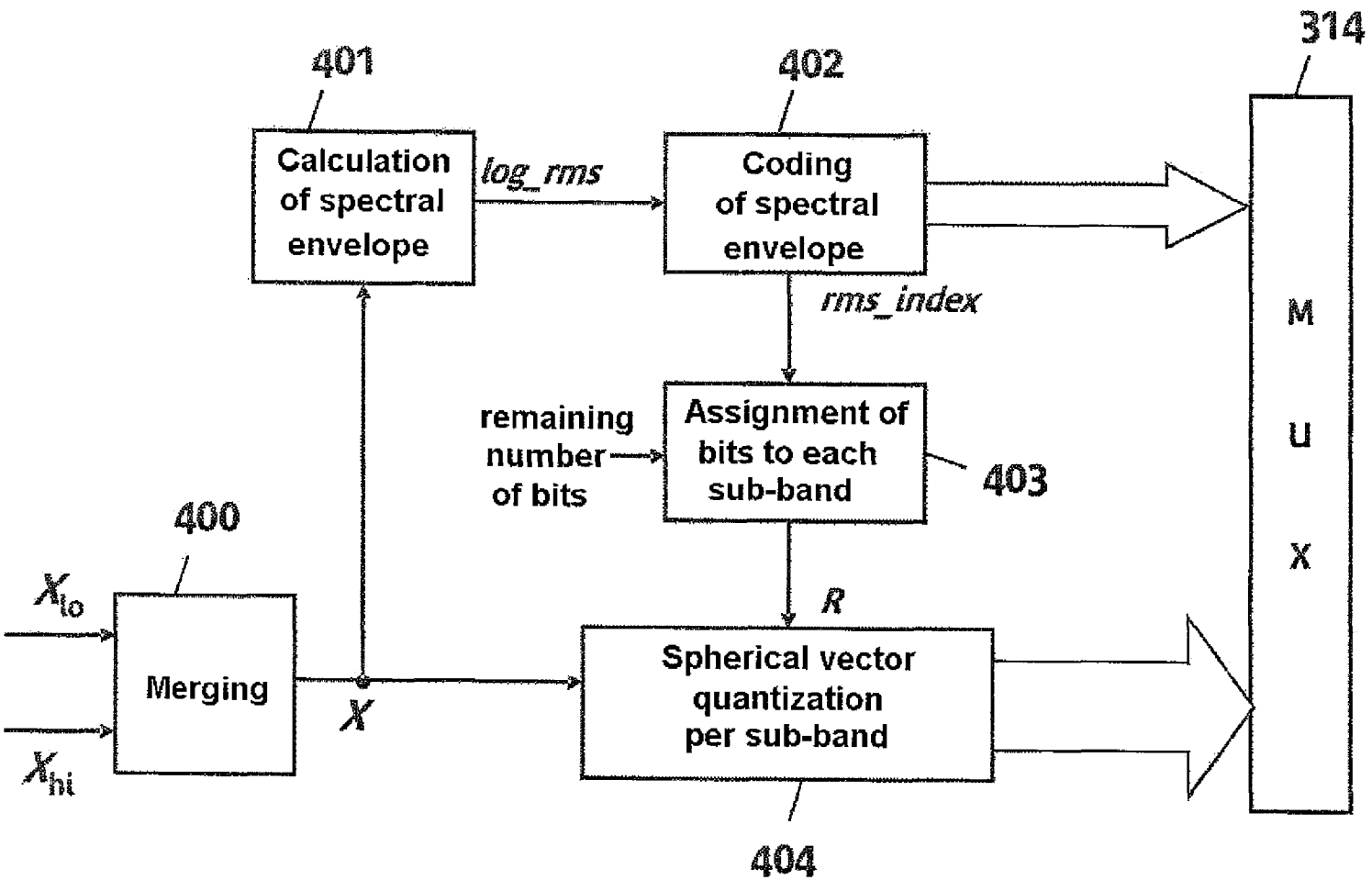
FIG. 5 is a detailed diagram of the FIG. 4 MDCT coder.

The MDCT coder 313 is described in detail with reference to FIG. 5.

The low-band and high-band MDCT transforms are first combined in the merging block 400. The coefficients $$X_{lo}=\{X_{lo}(0)X_{lo}(1)\ldots X_{lo}(N-1)\} \text{ and}$$

$$X_{hi}=\{X_{hi}(0)X_{hi}(1)\ldots X_{hi}(N-1)\}$$

are therefore grouped into a single vector to form a full band discrete transformed spectrum:

$$X=\{X(m)\}_{m=0\ldots L-1}=\{X_{lo}(0)X_{lo}(1)\ldots X_{lo}(N-1)X_{hi}(0)\ X_{hi}(1)\ldots X_{hi}(N-1)\}$$

The MDCT coefficients X(0), . . . , X(L−1) of X are grouped into K sub-bands. The division into sub-bands can be described by a table tabis={tabis(0) tabis(1) . . . tabis(K)} of K+1 elements defining the frontiers of the sub-bands. The first sub-band then includes the coefficients X(tabis(0)) to X(tabis(1)−1), the second sub-band includes the coefficients X(tabis(1)) to X(tabis(2)−1), etc.

In a preferred embodiment, K=18; the associated division is specified in table (a) in FIG. 7.

The spectral envelope of amplitude log_rms describing the energy distribution per sub-band is calculated 401 and then coded 402 by the spectral envelope coder to obtain the indices rms_index. The bits are assigned 403 to each sub-band and spherical vector quantization 404 is applied to the spectrum X. In a preferred embodiment, the assignment of the bits corresponds to the method disclosed in the paper by Y. Mahieux, J. P. Petit, "Transform coding of audio signals at 64 kbit/s", IEEE GLOBECOM, vol. 1, pp. 518-522, 1990, and spherical vector quantizing is effected as described in the International Application PCT/FR04/00219.

The bits resulting from coding the spectral envelope and vector quantization of the MDCT coefficients are processed by the multiplexer 314.

The spectral envelope calculation and coding are more particularly described below.

The spectral envelope log_rms in the logarithmic domain is defined for the $j^{th}$ sub-band as follows:

$$\text{log_rms}(j)=\frac{1}{2}\log_2\left[\frac{1}{\text{nb_coeff}(j)}\sum_{m=tabis(j)}^{tabis(j+1)-1}X(m)^2+\varepsilon\right]$$

where j=0, . . . , K−1 and nb_coeff(j)=tabis(j+1)−tabis(j) is the number of coefficients in the $j^{th}$ sub-band. The term $\epsilon$ serves to avoid $\log_2(0)$. The spectral envelope corresponds to the rms value in dB of the $j^{th}$ sub-band; it is therefore an amplitude envelope.

The size nb_coeff(j) of the sub-bands in a preferred embodiment is given in table (b) in FIG. 7. Moreover, $\epsilon=2^{-24}$, which implies log_rms(j)≧−12.

Figure 6:
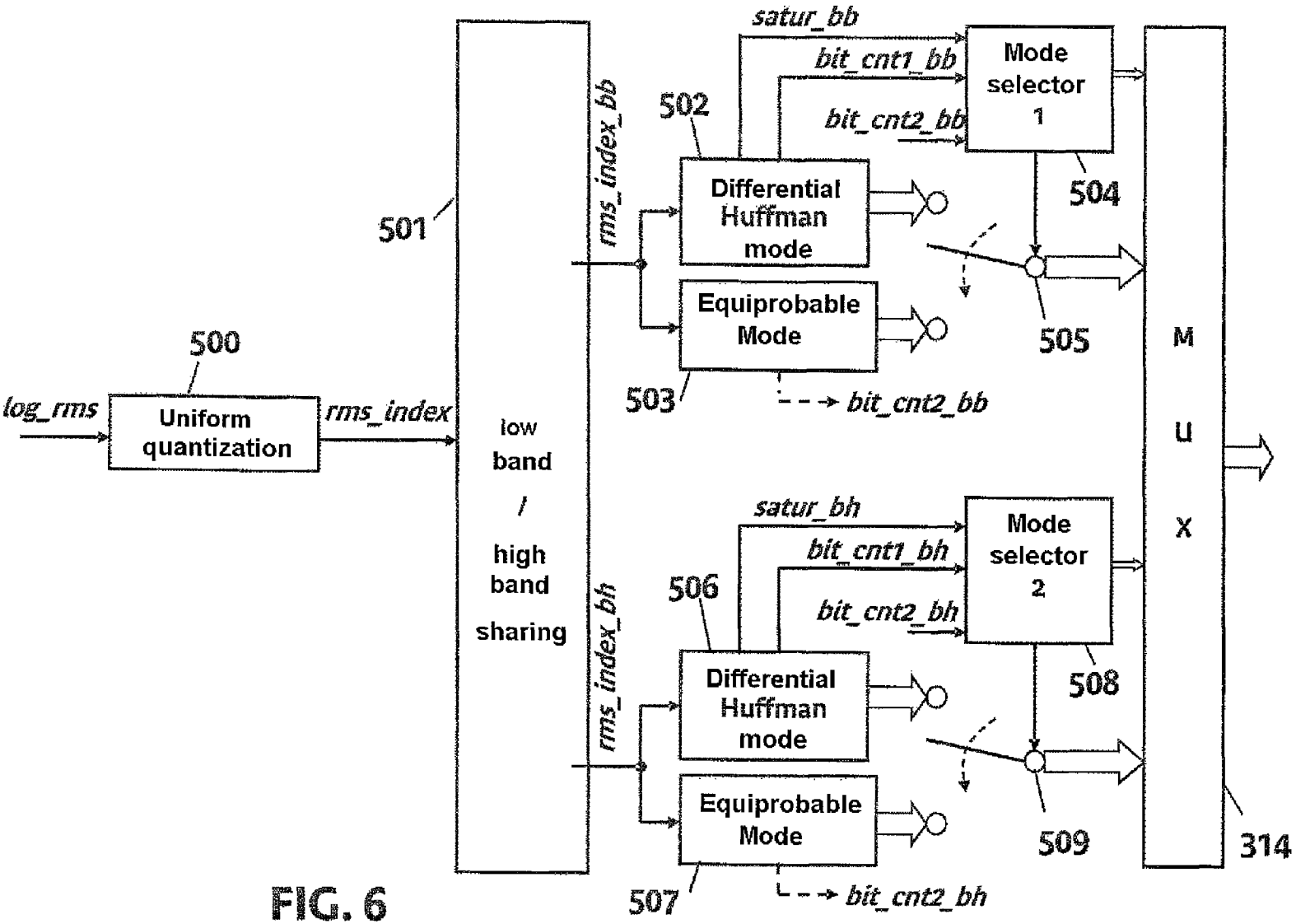
FIG. 6 a diagram of the spectral envelope coding module of the FIG. 5 MDCT coder.

The coding of the spectral envelope by the coder 402 is shown in FIG. 6.

The envelope log_rms in the logarithmic domain is first rounded to rms_index={rms_index(0) rms_index(1) . . . rms_index(K−1)} by uniform quantization 500. That quantization is simply given by:

$$rms_index(j)=\text{rounded to nearest integer of log_rms}(j)\times 0.5$$

if rms_index(j)<−11, rms_index(j)=−11 if rms_index(j)>+20, rms_index(j)=+20

The spectral envelope is then coded with uniform logarithmic steps of $20\times\log_{10}(2^{0.5})=3.0103, \ldots$ dB. The resulting vector rms_index contains integer indices from −11 to +20 (i.e. 32 possible values). The spectral envelope is therefore represented with a dynamic range of the order of 32×3.01=96.31 dB.

The quantized envelope rms_index is then divided into two sub-vectors by the block 501: one sub-vector rms_index bb={rms_index(0) rms_index(1) . . . rms_index(K_BB−1)} for the low-band envelope and the other vector rms_index bh={rms_index(K_BB) . . . rms_index(K−1)} for the high band envelope. In a preferred embodiment, K=18 and K_BB=10; in other words, the first 10 sub-bands are in the low band (0 to 4000 Hz) and the last 8 are in the high band (4000 Hz to 7000 Hz).

The low band envelope rms_index_bb is binarized by two coding modules 502 and 503 operating in competition, namely a variable length differential coding module 502 and a fixed length ("equiprobable") coding module 503. In a preferred embodiment, the module 502 is a differential Huffman coding module and the module 503 is a natural binary coding module.

The differential Huffman coding module 502 includes two coding steps described in detail below:

calculation of differential indices.

The differential quantization indices diff_index(1) diff_index(2) . . . diff_index(K_BB−1) are given by:

satur_bb=0

*diff*_index(*j*)=*rms*_index(*j*)−*rms*_index(*j*−1)

if (*diff*_index(*j*)<−12) or (*diff*_index(*j*)>+12), then satur_bb=1

The binary indicator satur_bb is used to detect situations in which diff_index(j) is not in the range [−12, +12]. If satur_bb=0, all the elements are in that range and the differential Huffman coding index range is sufficient; otherwise, one of these elements is less than −12 or greater than +12 and said range of indices is then insufficient. The indicator satur_bb is therefore used to detect spectral envelope saturation by differential Huffman coding in the low band. If saturation is detected, the coding mode is changed to the fixed length (equiprobable) coding mode. By design, the range of indices of the equiprobable mode is always sufficient.

binary conversion of first index and Huffman coding of differential indices:

- the quantization index rms_index(0) has an integer value from −11 to +20. It is coded directly in binary with a fixed length of 5 bits. The differential quantization indices diff_index(j) for j=1 . . . K_BB−1 are then converted into binary form by Huffman coding (variable length). The Huffman table used is specified in the FIG. 8 table.
- the total number bit_cnt1_bb of bits resulting from this binary conversion of rms_index(0) and Huffman coding of the quantization indices diff_index(j) varies.
- in a preferred embodiment, the maximum length of a Huffman code is 14 bits and Huffman coding is applied to K_BB−1=9 differential indices in the low band. Thus the theoretical maximum value of bit_cnt1_bb is 5+9×14=131 bits. Although this is only a theoretical value, note that in the worst case scenario the number of bits used by spectral envelope coding in the low band can be very high; limiting the worse case scenario is precisely the role of equiprobable coding.

The equiprobable coding module 503 converts directly to natural binary form the elements rms_index(0) rms_index (1) . . . rms_index(K_BB−1). These range from −11 to +20 and are therefore each coded on 5 bits. The number of bits necessary for equiprobable coding is therefore simply: bit_cnt2_bb=5×K_BB bits. In a preferred embodiment, K_BB=10, thus bit_cnt2_bb=50 bits.

The mode selector 504 selects which of the two modules 502 or 503 (differential Huffman coding or equiprobable coding) generates the lower number of bits. As the differential Huffman mode saturates the differential indices at +/−12, the equiprobable mode is chosen as soon as saturation is detected in the calculation of the differential quantization indices. This method avoids spectral envelope saturation as soon as the difference between the rms values of two adjacent bands exceeds 12×3.01=36.12 dB. Mode selection is explained below:

if (satur_bb=1) or (bit_cnt2_bb<bit_cnt1_bb), the equiprobable mode is selected;

if not, the differential Huffman mode is selected.

The mode selector 504 generates a bit that indicates which of the differential Huffman or equiprobable modes has been selected, using the following convention: 0 for the differential Huffman mode, 1 for the equiprobable mode. This bit is multiplexed with the other bits generated by coding the spectral envelope in the multiplexer 510. Also, the mode selector 504 triggers a bistable 505 that multiplexes the bits of the selected coding mode in the multiplexer 314.

The high band envelope rms_index_bh is processed in exactly the same way as rms_index_bb: uniform coding of the first index log_rms(0) on 5 bits by the equiprobable coding module 507 and Huffman coding of the differential indices by the coding module 506. The Huffman table used in the module 506 is identical to that used in the module 502. Similarly, the equiprobable coding 507 is identical to the coding 503 in the low band. The mode selector 508 generates a bit that indicates which mode (differential Huffman mode or equiprobable mode) has been selected, and that bit is multiplexed with the bits from the bistable 509 in the multiplexer 314. The number of bits necessary for equiprobable coding in the high band is bit_cnt2_bh=(K−K_BB)×5; in the preferred embodiment, K−K_BB=8 thus bit_cnt2_bh=40 bits.

It is important to note that in the preferred embodiment the bits associated with the envelope of the high band are multiplexed before the bits associated with the envelope of the low band. In this way, if only part of the coded spectral envelope is received by the decoder, the envelope of the high band can be decoded before that of the low band.

Figure 9:
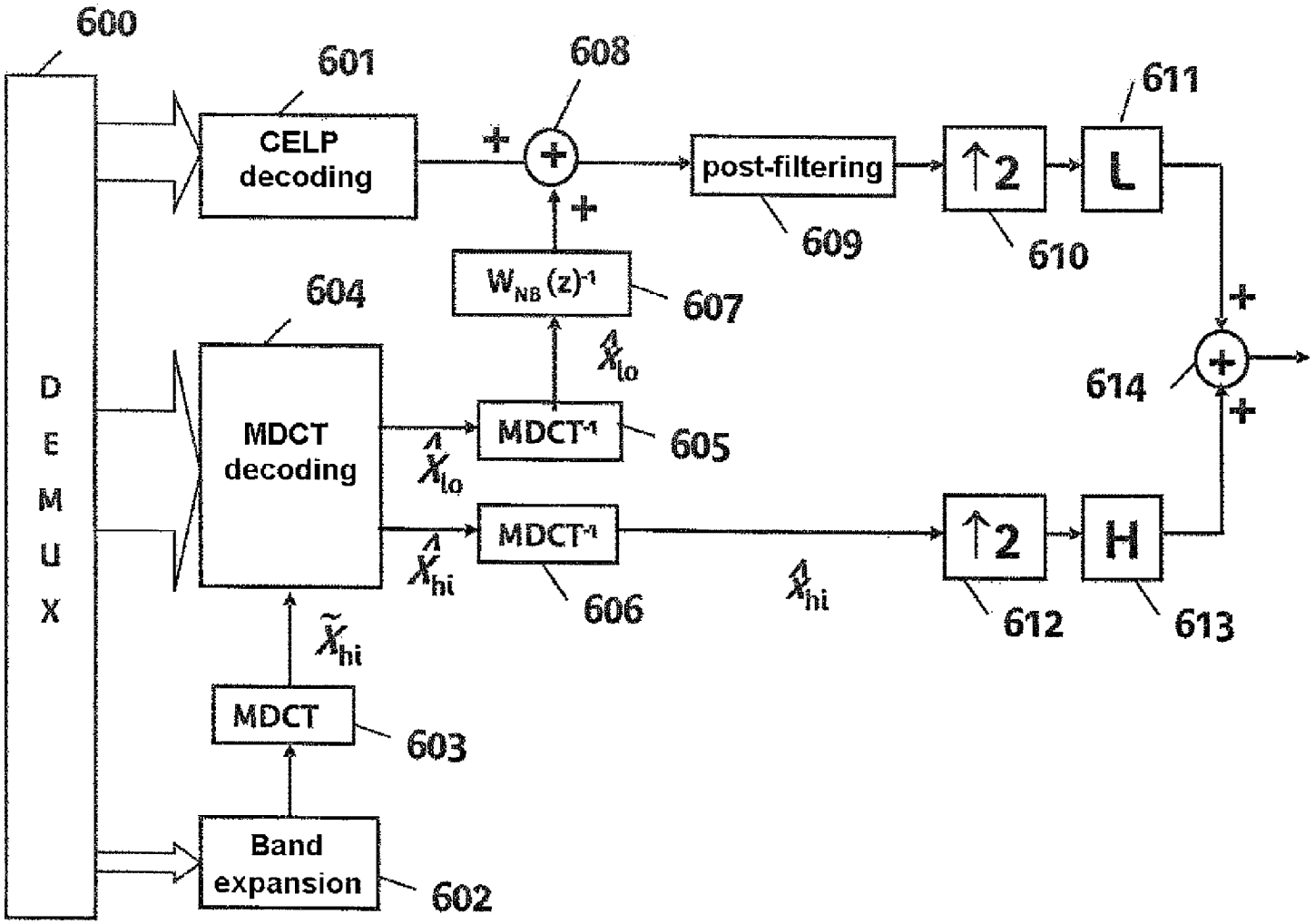
FIG. 9 is a diagram of a hierarchical audio decoder including an MDCT decoder provided in an embodiment of the invention.

The hierarchical audio decoder associated with the coder that has just been described is shown in FIG. 9. The bits defining each 20 ms frame are demultiplexed in the demultiplexer 600. Decoding at 8 kbit/s to 32 kbit/s is shown here. In practice, the bit stream may have been truncated to 8 kbit/s, 12 kbit/s, 14 kbit/s or from 14 kbit/s to 32 kbit/s in steps of 2 kbit/s.

Figure 10:
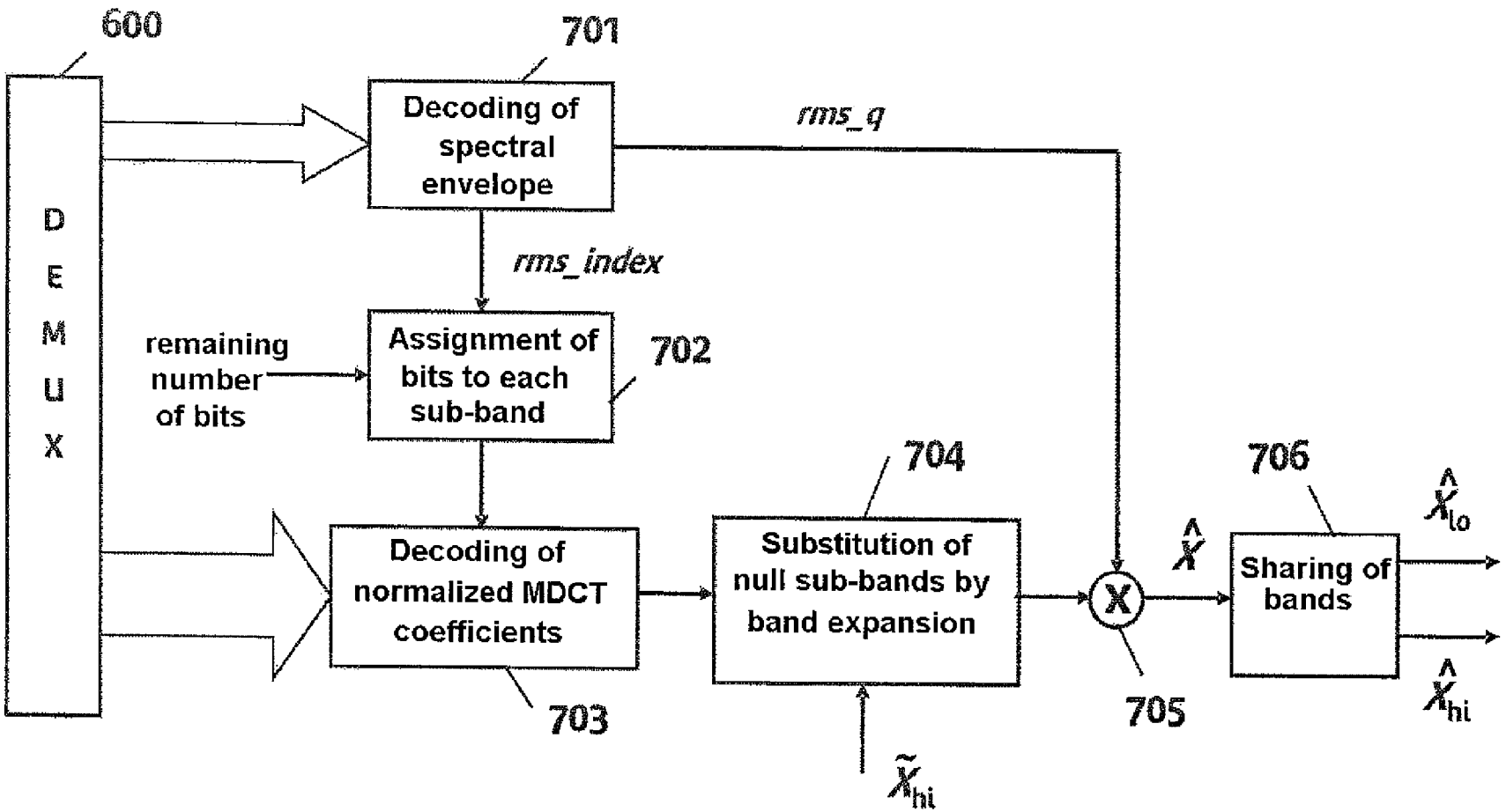
FIG. 10 is a detailed diagram of the FIG. 9 MDCT decoder.

The bit stream of the layers at 8 and 12 kbit/s is used by the CELP decoder 601 to generate a first narrow band (0 to 4000 Hz) synthesis. The portion of the bit stream associated with the 14 kbit/s layer is decoded by the band expansion module 602. The signal obtained in the high band (4000 Hz to 7000 Hz) is transformed into a transform signal $\tilde{X}_{hi}$ by applying the MDCT transform 603. The MDCT decoding 604 is shown in FIG. 10 and discussed below. From the bit stream associated with the bit rates from 14 kbit/s to 32 kbit/s a reconstructed spectrum $\tilde{X}_{lo}$ is generated in the low band and a reconstructed spectrum $\tilde{X}_{hi}$ is generated in the high band. These spectra are converted to time-domain signals $\tilde{x}_{lo}$ and $\tilde{x}_{hi}$ by an inverse MDCT transform in the blocks 605 and 606. The signal $\tilde{x}_{lo}$ is added to the CELP synthesis 608 after inverse perceptual filtering 607 and the result is then post-filtered 609.

The wide band output signal sampled at 16 kHz is obtained by means of the synthesis QMF filter bank including oversampling 610 and 612, low-pass and high-pass filtering 611 and 613, and summation 614.

The MDCT decoder 604 is described below with reference to FIG. 10.

Figure 11:
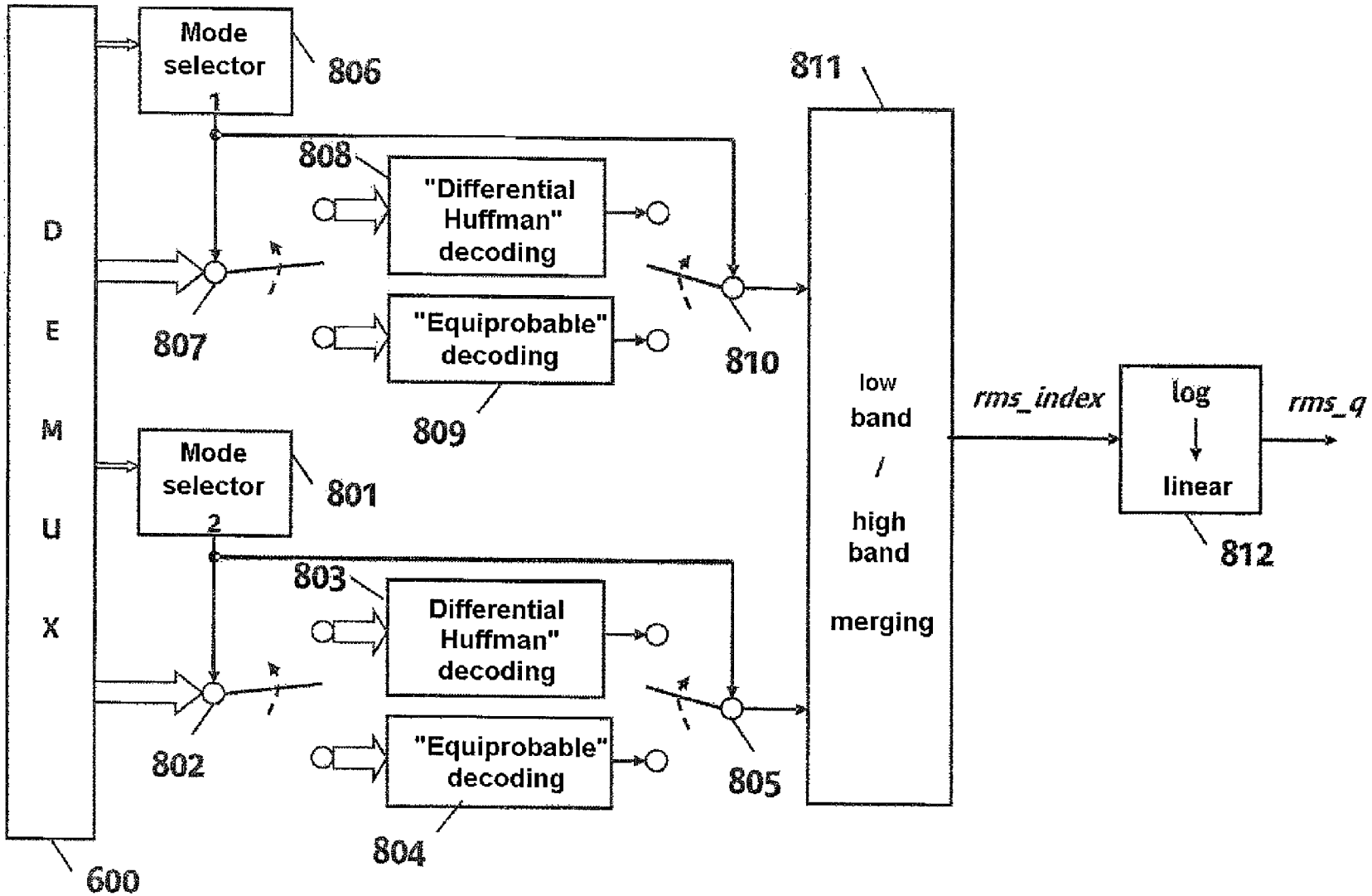
FIG. 11 is a diagram of the spectral envelope decoding module of the FIG. 10 MDCT decoder.

The bits associated with this module are demultiplexed in the demultiplexer 600. The spectral envelope is first decoded 701 to obtain the indices rms_index and the linear scale reconstructed spectral envelope rms_q. The decoding module 701 is shown in FIG. 11 and described below. In the absence of bit errors and if all the bits defining the spectral envelope are received correctly, the indices rms_index correspond exactly to those calculated in the coder; this property is essential because the assigning of the bits 702 requires the same information in the coder and in the decoder so that the coder and the decoder are compatible. The standardized MDCT coefficients are decoded in the block 703.

Sub-bands that have not been received or not coded, because of having too little energy, are replaced by those from the spectrum $\tilde{X}_{hi}$ in the substitution module 704. Finally, the module 705 applies the amplitude envelope per sub-band to the coefficients supplied at the output of the module 704, and the reconstructed spectrum $\tilde{X}$ is separated 706 into a reconstructed spectrum $\tilde{X}_{lo}$ in the low band (0 to 4000 Hz) and a reconstructed spectrum $\tilde{X}_{hi}$ in the high band (4000 Hz to 7000 Hz).

FIG. 11 shows the decoding of the spectral envelope. The bits associated with the spectral envelope are demultiplexed by the demultiplexer 600.

In the preferred embodiment, the bits associated with the spectral envelope of the high band are transmitted before those of the low band. Thus decoding begins with reading in the mode selector 801 the value of the mode selection bit received from the coder (differential Huffman mode or equiprobable mode). The selector 801 conforms to the same convention as on coding, namely: 0 for the differential Huffman mode, 1 for the equiprobable mode. The value of this bit drives the bistables 802 and 805.

If the mode selection bit is at 0, differential Huffman decoding is effected by the variable length decoding module 803: the absolute value rms_index(K_BB) from −11 to +20 and represented on 5 bits is decoded first, followed by the Huffman codes associated with the differential quantization indices diff_index(j) for j=K_BB·K−1 are then decoded. The integer indices rms_index(j) are then reconstructed using the following expression, for j=K_BB·K−1:

$$rms_index(j)=rms_index(j-1)+diff_index(j)$$

If the mode selection bit is at 1, the values of rms_index(j) from −11 to +20 and represented on 5 bits for j=K_BB·K−1 are decoded successively by the fixed length decoding module 804.

If no Huffman code has been found in mode 0 or if the number of bits received is insufficient to decode the high band completely, the decoding process indicates to the MDCT decoder that an error has occurred.

The bits associated with the low band are decoded in the same way as those associated with the high band. This decoding portion therefore includes the mode selector 806, the bistables 807 and 810, and the decoding modules 808 and 809.

The low-band reconstructed spectral envelope includes the integer indices rms_index(j) for j=K_BB·K−1. That reconstructed in the low band includes the integer indices rms_index(j) for j=0 . . . K_BB−1. These indices are grouped into a single vector rms_index={rms_index(0) rms_index(1) . . . rms_index(K−1)} in the merging block 811. The vector rms_index represents the reconstructed spectral envelope on a base 2 logarithmic scale; the spectral envelope is converted to a linear scale by the conversion module 812, which performs the following operation, where j=0, . . . , K−1:

$$rms_q(j)=2^{rms_index(j)}$$

It is obvious that the invention is not limited to the embodiment that has just been described. In particular, it should be noted that the envelope as coded by the invention can correspond to the time envelope defining the rms value per sub-frame of a signal rather than a spectral envelope defining the rms value per sub-frame.

Moreover, the fixed length coding step in competition with differential Huffman coding can be replaced by a variable length coding step, for example Huffman coding of the quantization indices instead of Huffman coding of the differential indices. Huffman coding can also be replaced by any other lossless coding, such as arithmetic coding, Tunstall coding, etc.

The invention claimed is:

1. A method of binary coding quantization indices representing an audio signal envelope in an audio signal coder, the method comprising:

executing, in the audio signal coder, a variable length first coding mode to perform coding of the audio signal, the first coding mode incorporating envelope saturation detection to detect whether the quantization indices of the audio signal envelope exceed a range of quantization indices that can be represented by the first coding mode;

executing, in the audio signal coder, a second coding mode in parallel with the first coding mode to perform coding of the audio signal; and selecting one of the first and second coding modes as a function of a code length criterion and a result of detecting envelope saturation in the first coding mode.

2. The method according to claim 1, wherein the second coding mode is selected if one or more of the following conditions is satisfied:

the code length of the second coding mode is shorter than the code length of the first coding mode; and detection of envelope saturation in the first coding mode indicates saturation.

3. The method according to claim 1, wherein said method also includes a step of generating a selected coding mode indicator.

4. The method according to claim 3, wherein said indicator is a single bit.

5. The method according to claim 1, wherein said second coding mode is fixed length natural binary coding.

6. The method according to claim 1, wherein said variable length first coding mode is variable length differential coding.

7. The method according to claim 1, wherein said variable length first coding mode is differential Huffman coding.

8. The method according to claim 1, wherein said quantization indices are obtained by scalar quantization of a frequency envelope defining the energy in sub-bands of said audio signal.

9. The method according to claim 8, wherein a first sub-band is fixed length coded and a differential energy of a second sub-band relative to the first sub-band is variable length coded.

10. The method according to claim 1, wherein said quantization indices are obtained by scalar quantization of a time envelope defining the energy in sub-frames of said audio signal.

11. The method according to claim 10, wherein a first sub-frame is fixed length coded and a differential energy of a second sub-frame relative to the first sub-frame is variable length coded.

12. A method of coding and decoding which includes binary coding quantization indices representing an audio signal envelope in an audio signal coder and decoding a resulting coded audio signal envelope in an audio signal decoder, the method comprising:

executing, in the audio signal coder, a variable length first coding mode to perform coding of the audio signal, the first coding mode incorporating envelope saturation detection to detect whether the quantization indices of the audio signal envelope exceed a range of quantization indices that can be represented by the first coding mode;

executing, in the audio signal coder, a second coding mode in parallel with the first coding mode to perform coding of the audio signal;

selecting one of the first and second coding modes as a function of a code length criterion and a result of detecting envelope saturation in the first coding mode;

generating a selected coding mode indicator; and detecting said selected coding mode indicator and performing decoding in accordance with the selected coding mode.

13. A module for binary coding of quantization indices representing an audio signal envelope in an audio signal coder, the module for binary coding comprising:

a first module for receiving an audio signal and coding the audio signal in a variable length first coding mode to generate a first output digital bit stream, including an envelope saturation detector to detect whether the quantization indices of the audio signal envelope exceed a range of quantization indices that can be represented by the first coding mode;

a second module for receiving the audio signal and coding the audio signal in a second coding mode, in parallel with the first module for coding the first coding mode, to generate a second output digital bit stream; and a mode selector for retaining one of the first and second coding modes as a function of a code length criterion and the result from the envelope saturation detector.

14. The module according to claim 13, wherein said mode selector is adapted to generate a selected coding mode indicator.

15. A system comprising a module for binary coding of quantization indices representing an audio signal envelope in an audio signal coder and a module for decoding a resulting coded audio signal envelope, the module for binary coding comprising:

a first module for coding the audio signal in a variable length first coding mode, including an envelope saturation detector to detect whether the quantization indices of the audio signal envelope exceed a range of quantization indices that can be represented by the first coding mode;

a second module for coding the audio signal in a second coding mode, in parallel with the module for coding the first coding mode; and a mode selector for retaining one of the first and second coding modes as a function of a code length criterion and the result from the envelope saturation detector, wherein said mode selector is adapted to generate a selected coding mode indicator, and the module for decoding comprising:

a first decoding module for decoding a variable length first coding mode;

a second decoding module for decoding a second coding mode in parallel with said decoding module for decoding the first coding mode; and a mode detector adapted to detect said coding mode indicator and to activate the decoding module corresponding to the detected indicator.

16. A program comprising instructions stored on a non-transitory computer-readable medium for executing the steps of the method according to claim 1 when said program is executed in a computer.

* * * * *